US006340264B1

(12) United States Patent
Nelson

(10) Patent No.: US 6,340,264 B1
(45) Date of Patent: Jan. 22, 2002

(54) COUPLING ASSEMBLY, CONNECTING MEMBER AND ARTICLES MANUFACTURED THEREFROM

(75) Inventor: Thomas J. Nelson, Belton, TX (US)

(73) Assignee: Premark RWP Holdings, Inc., Wilmington, DE (US)

( * ) Notice: Subject to any disclaimer, the term of this patent is extended or adjusted under 35 U.S.C. 154(b) by 0 days.

(21) Appl. No.: 09/277,184

(22) Filed: Mar. 26, 1999

(51) Int. Cl.[7] ..... F16B 12/36
(52) U.S. Cl. ..... 403/297
(58) Field of Search ..... 403/11, 12, 13, 403/14, 373, 374.1, 374.4, 374.5, 321, 322.1, 409.1, 2; 411/84, 85, 40, 41

(56) References Cited

U.S. PATENT DOCUMENTS

| | | | | |
|---|---|---|---|---|
| 1,124,228 A | | 1/1915 | Houston | |
| 1,430,996 A | | 10/1922 | Horlin | 52/468 X |
| 2,671,538 A | | 3/1954 | Horowitz et al. | 52/464 |
| 2,996,751 A | * | 10/1961 | Roby et al. | |
| 3,381,436 A | | 5/1968 | Elliott et al. | 52/468 |
| 3,508,369 A | * | 4/1970 | Tennison | |
| 3,570,205 A | * | 3/1971 | Payne | |
| 3,688,460 A | * | 9/1972 | Van Loghem et al. | |
| 3,823,525 A | | 7/1974 | Bruun | |
| 3,889,320 A | * | 6/1975 | Koscik | |
| 4,067,155 A | * | 1/1978 | Ruff et al. | |
| 4,069,731 A | * | 1/1978 | Stang | |
| 4,125,984 A | | 11/1978 | Jonas | |
| 4,385,850 A | | 5/1983 | Bobath | 52/461 X |
| 4,405,272 A | | 9/1983 | Wollar | 411/41 |
| 4,407,618 A | * | 10/1983 | Kimura | |
| 4,461,131 A | | 7/1984 | Pressell | 52/395 |
| 4,648,231 A | | 3/1987 | Laroche | 52/775 |
| 4,653,138 A | | 3/1987 | Carder | 16/4 |

(List continued on next page.)

FOREIGN PATENT DOCUMENTS

| | | | |
|---|---|---|---|
| DE | 1714532 | 1/1956 | E04F/19/06 |
| DE | 3635167 | 4/1988 | E04F/19/06 |
| DE | 197 13 542 | 10/1998 | |
| EP | 519856 | 12/1992 | E04D/3/08 |
| EP | 696667 | 2/1996 | E04F/19/06 |

(List continued on next page.)

OTHER PUBLICATIONS

Duo Grip.*

Parador Flooring Product Advertisement for Parador Holzwerke GMBH & CO. KG, Australian House and Garden Jun. 2001.

Kuegele, Duo Grip, the Fastening Solution for Parquet and Laminate, M.A. Kuegle Ges.m.b.H, P.O. Box 55–A–1104 Vienna, Austria.

Kuegele, Profiles for Laminate and Parquet, M.A. Kuegle Ges.m.b.H., PO Box 55, A–1104, Vienna, Austria.

INPADOC Information for Patent Family Including U. S. Patents 5,860,267 and 6,023,907 (Nov. 20, 2000).

*Primary Examiner*—Lynne H. Browne
*Assistant Examiner*—Tomlyne A Malcolm
(74) *Attorney, Agent, or Firm*—Welsh & Flaxman LLC

(57) ABSTRACT

A coupling assembly securely attaching moldings to a support surface. The coupling assembly includes a track member having first and second upwardly extending flanges defining a channel. The coupling assembly also includes a connecting member shaped and dimensioned for secure attachment within the channel defined by the upwardly extending flanges. The connecting member includes first and second expansion members which move outwardly as the connecting member is forced downwardly within the channel to securely couple the connecting member within the track member and to force the first and second upwardly extending flanges outwardly into engagement with the molding such that the molding is securely coupled to the track member. A connecting member used in conjunction with the coupling assembly and a multi-component article including the present coupling assembly are also disclosed.

29 Claims, 6 Drawing Sheets

U.S. PATENT DOCUMENTS

| | | | | | |
|---|---|---|---|---|---|
| 5,332,075 | A | | 7/1994 | Quigley et al. | 192/107 R |
| 5,348,778 | A | | 9/1994 | Knipp et al. | |
| 5,618,602 | A | | 4/1997 | Nelson | |
| 5,641,255 | A | * | 6/1997 | Tanaka | 411/48 |
| 5,706,623 | A | * | 1/1998 | Brown | |
| 6,089,805 | A | * | 7/2000 | Salmon | |
| 6,094,882 | A | | 8/2000 | Pervan | |
| 6,134,854 | A | | 10/2000 | Stanchfield | 52/480 |
| 6,182,410 | B1 | | 2/2001 | Pervan | |
| 6,205,639 | B1 | | 3/2001 | Pervan | |

FOREIGN PATENT DOCUMENTS

| | | | | |
|---|---|---|---|---|
| EP | 839974 | | 6/1998 | E04F/19/06 |
| EP | 0855482 | B1 | 12/1999 | |
| EP | 0877130 | B1 | 1/2000 | |
| EP | 0969164 | A2 | 1/2000 | |
| FR | 531202 | * | 9/1954 | |
| GB | 2257040 | | 1/1993 | A47G/27/04 |
| GB | 2 257 040 | * | 6/1993 | |
| HU | 214470 | B | 4/1994 | |
| IT | 519890 | | 3/1955 | 52/461 |

* cited by examiner

COUPLING ASSEMBLY, CONNECTING MEMBER AND ARTICLES MANUFACTURED THEREFROM

BACKGROUND OF THE INVENTION

1. Field of the Invention

The invention relates to a coupling arrangement for attaching first and second members. More particularly, the invention relates to a dovetail type coupling arrangement for securing molding to a support surface.

2. Description of the Prior Art

It is often desirable to place a transition molding between adjacent rooms of flooring. This is especially common where the flooring material changes from room to room. For example, as a decorative laminate hallway transitions into a tile kitchen, a transition molding is commonly positioned between the two rooms.

In many instances the molding is simply nailed to the underlying subfloor. As anyone who has installed molding with nails knows, attaching the molding to the support surface is very difficult, and the nail heads are almost impossible to hide. Surface scarring is also encountered when individuals install chair rails, crown molding, shoe molding and a variety of other moldings throughout a home or office. Moldings scarred in this manner are aesthetically undesirable, and attempts have been made to provide attachment mechanisms which reduce the likelihood that the molding will be scarred as a result of the installation process.

Aluminum tracks are commercially used for the installation of flexible molding, such as vinyl molding. This includes the installation of expansion and transition molding, end caps and reducer strips. In accordance with the prior methods, the molding is an extruded length of flexible vinyl, or other polymer, including a downwardly extending connecting member with outwardly extending ribs. The connecting member is shaped for positioning within the track.

In practice, the aluminum track is affixed to the floor and the connecting member on the back of the flexible molding is interlocked between a pair of flanges extending from the upper surface of the track. Ribs extending along the connecting member and the interior surfaces of the flanges interlock to resist the removal of the rib from the flanges. In this way, the molding is "pinched" in position by the track.

Others have also attempted to develop systems for attaching rigid molding to a support surface. For example, one prior art technique for attaching wood molding employs a recess in the molding and a rib projection on the track member to secure the molding to a support surface. Specifically, a recess with parallel walls is formed in the molding. The recess is shaped and dimensioned to fit over a single ribbed flange extending upwardly from the track member. The ribbed flange includes outwardly extending ribs on opposite sides. The ribs engage the parallel walls of the molding's recess to securely mount the molding on the support surface. Unfortunately, movement of the recess along the ribbed flange saws away at the recess wall, ultimately resulting in the loosening of the molding.

As discussed above, prior connecting assemblies exhibit many shortcomings. For example, they commonly loosen over time as pressure is applied to the molding during normal use. In addition, prior connecting assemblies require that specific ribs be integrally formed with the molding and are often cumbersome to install. In fact, where such ribs are used in conjunction with wood-based molding, the simple act of installing the rib between the flanges commonly results in the shearing off of the rib and the soon to follow loosening of the molding.

After studying prior connecting assemblies, it is clear that a versatile, convenient, and reliable coupling assembly is needed for attaching molding to a support surface. The present invention provides such a coupling assembly, as well as articles manufactured with the coupling assembly and a connecting member for use with the coupling assembly.

SUMMARY OF THE INVENTION

It is, therefore, an object of the present invention to provide a coupling assembly for securely attaching moldings to a support surface. The coupling assembly includes a track member having first and second upwardly extending flanges defining a channel. The coupling assembly also includes a connecting member shaped and dimensioned for secure attachment within the channel defined by the upwardly extending flanges. The connecting member includes first and second expansion members which move outwardly as the connecting member is forced downwardly within the channel to securely couple the connecting member within the track member and to force the first and second upwardly extending flanges outwardly into engagement with the molding such that the molding is securely coupled to the track member.

It is also an object of the present invention to provide a connecting member adapted for coupling molding to a track member secured to a support surface. The connecting member includes a central spike, a first expansion member extending from one side of the central spike and a second expansion member extending from an opposite side of the central spike. In use, the first expansion member and the second expansion member move outwardly as the central spike is forced downwardly within the channel to securely couple the connecting member within the track member and to force the first and second upwardly extending flanges outwardly into engagement with the molding such that the molding is securely coupled to the track member.

It is a further object of the present invention to provide a multi-component article including the present coupling assembly connecting a first member to a second member.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
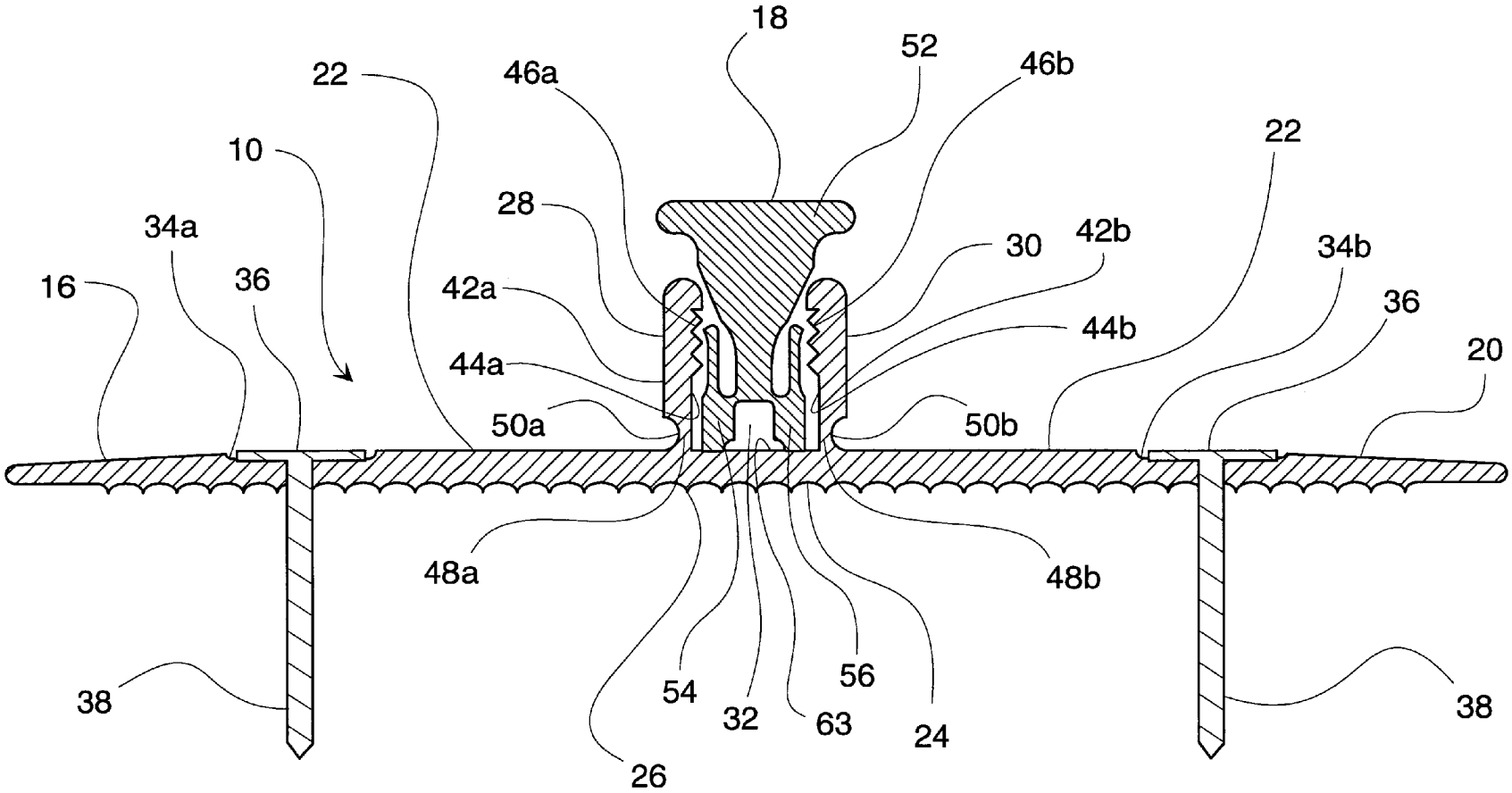
FIG. 1 is a cross sectional view of the present coupling assembly.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1–7, a coupling assembly 10 securely coupling molding 12 to a support surface 14 is disclosed. The coupling assembly 10 includes a track member 16 and a connecting member 18. The connecting member 18 is shaped and dimensioned for secure attachment to the track member 16.

The track member 16 is preferably formed from extruded aluminum, although other materials may be used without departing from the spirit of the present invention. The connecting member 18 is injection molded and formed from high density polyethylene, although other materials and manufacturing techniques may be employed without departing from the spirit of the present invention.

The track member 16 is an elongated member which is cut to a desired length before use. The track member 16 includes a base 20 with a top surface 22 and a bottom surface 24. The bottom surface 24 of the track member 16 is provided with longitudinally extending grooves 26 enhancing the secure attachment of the track member 16 to a support surface 14. The top surface 22 includes first and second upwardly extending flanges 28, 30 defining a channel 32.

The top surface 22 further includes longitudinally extending recesses 34*a*, 34*b* on opposite sides of the first and second flanges 28, 30. The recesses 34*a*, 34*b* provide space allowing the heads 36 of the securing nails 38 to lie substantially flush with the top surface 22 of the track member 16. A longitudinal groove 40*a*, 40*b* is formed within the center of each recess 34*a*, 34*b*. The groove 40*a*, 40*b* is designed to guide the tip of a nail 38 as it is fastened to the track member 16.

The first and second upwardly extending flanges 28, 30 are substantially mirror images of each other. As such, each flange includes an exterior surface 42*a*, 42*b* and an interior surface 44*a*, 44*b*. The exterior surface 42*a*, 42*b* is substantially smooth, although it may include texturing, serrations or other variations, without departing from the spirit of the present invention. For reasons that will be better appreciated based upon the following disclosure, the smooth exterior surface 42*a*, 42*b* prevents movement of the molding 12 relative to the track member 16 from wearing away and loosening the molding 12.

The interior surface 44*a*, 44*b* of each flange 28, 30 is provided with inwardly directed ribs 46*a*, 46*b* shaped and dimensioned to engage the connecting member 18 in a manner that will be discussed below in greater detail. In addition, the base 48*a*, 48*b* of each flange 28, 30 includes a relieved section allowing the flange 28, 30 to flex outwardly for reasons discussed in greater detail below. Specifically, the exterior surface 42*a*, 42*b* of each flange 28, 30 includes a recessed section 50*a*, 50*b* adjacent the base 48*a*, 48*b* of the flange 28, 30. The recessed section 50*a*, 50*b* provides additional flexibility at the base 48*a*, 48*b* of the flange 28, 30, permitting the flange 28, 30 to flex outwardly for the retention of molding 12 thereon.

The connecting member 18 is shaped and dimensioned for secure attachment within the channel 32. Each connecting member 18 is approximately ¾ inch long, although this length may be varied without departing from the spirit of the present invention. As will be discussed in greater detail below, the connecting members 18 are positioned at one foot intervals along the track member 16 during the installation process.

In practice, the connecting member 18 is designed to expand outwardly as it is forced downwardly within the channel 32. The connecting member 18 includes a central spike 52 with a first expansion member 54 extending from one side of the central spike 52 and a second expansion member 56 extending from an opposite side of the central spike 52. First and second frangible joints 58, 60 couple the first and second expansion members 54, 56 to the central spike 52.

Briefly, and as discussed in greater detail below, the first and second expansion members 54, 56 are releasably coupled to the central spike 52 such that the first expansion member 54 and the second expansion member 56 move outwardly as the central spike 52 is forced downwardly within the channel 32. As the first and second expansion members 54, 56 are forced outwardly, they act upon the first and second upwardly extending flanges 28, 30 to force the upwardly extending flanges 28, 30 outwardly into engagement with the molding 12 such that the molding 12 is securely coupled to the track member 16.

With this in mind, each expansion member 54, 56 includes a lower end 62*a*, 62*b* shaped and dimensioned for engagement with the floor 63 of the channel 32 as the central spike 52 is pushed downwardly within the channel 32. Each expansion member 54, 56 includes an upper end 64*a*, 64*b* shaped and dimensioned for receipt within the ribs 46*a*, 46*b* formed along the interior surface 44*a*, 44*b* of each upwardly extending flange 28, 30.

Collapse of the connecting member 18 within the channel 32 will now be described in detail. After the connecting member 18 is loosely inserted within the channel 32, the lower ends 62*a*, 62*b* of the first and second expansion members 54, 56 contact the floor 63 of the channel 32. Downward pressure is then applied to the central spike 52, for example, by a piece of molding 12 placed over the track member 16 and the connecting member 18.

As downward pressure is applied to the central spike 52, the first and second frangible joints 58, 60 break. That is, the first and second expansion members 54, 56 are broken from the central spike 52. The central spike 52 is then free to move downwardly within the channel 32, and between the first and second expansion members 54, 56.

As the central spike 52 moves downwardly between the first and second expansion members 54, 56, the outwardly tapering shaft 66 of the central spike 52 is brought into contact with the upper ends 64*a*, 64*b* of the first and second expansion members 54, 56, forcing the first and second expansion members 54, 56 to move outwardly and apply pressure to the upwardly extending flanges 28, 30. This pressure causes each flange 28, 30 to bow outwardly approximately 2½° in the presently described embodiment.

The unique shape of the connecting member 18 securely binds the connecting member 18 within the channel 32 as it applies pressure to the upwardly extending flanges 28, 30. Specifically, the lower end 62*a*, 62*b* of each expansion member 54, 56 includes interior recesses 68*a*, 68*b* shaped to respectively receive the remnant projections 69*a*, 69*b* remaining along the lower end 67 of the central spike 52 after it has split from the expansion members 54, 56. In this way, the central spike 52 is prevented from moving up once the connecting member 18 is fully seated within the channel 32.

In addition, the upper ends 64*a*, 64*b* of the expansion members 54, 56 are provided with dogs 72*a*, 72*b* which seat within the ribs 46*a*, 46*b* formed along the interior surfaces 44*a*, 44*b* of the first and second upwardly extending flanges 28, 30. As with the lower end 67 of the central spike 52 seating within recesses 68*a*, 68*b* formed along the lower ends 62*a*, 62*b* of the expansion members 54, 56, the dogs 72*a*, 72*b* prevent the connecting member 18 from moving up once it is fully seated within the channel 32.

The outward flexing provided by the coupling assembly 10 is used to securely couple a first member to a second member with a dovetail joint. For example, and in accordance with the preferred embodiment of the present invention, the present coupling assembly 10 may be employed in attaching molding 12 to a support surface 14. With reference to FIGS. 1–5, the track member 16 is first secured to the support surface 14. Nails 38 are used to secure the track member 16 to the support surface 14 in accordance with the preferred embodiment of the present invention, although other attachment mechanisms, such as, glue, screws, double sided tape etc, may be employed without departing from the spirit of the present invention.

Figure 2:
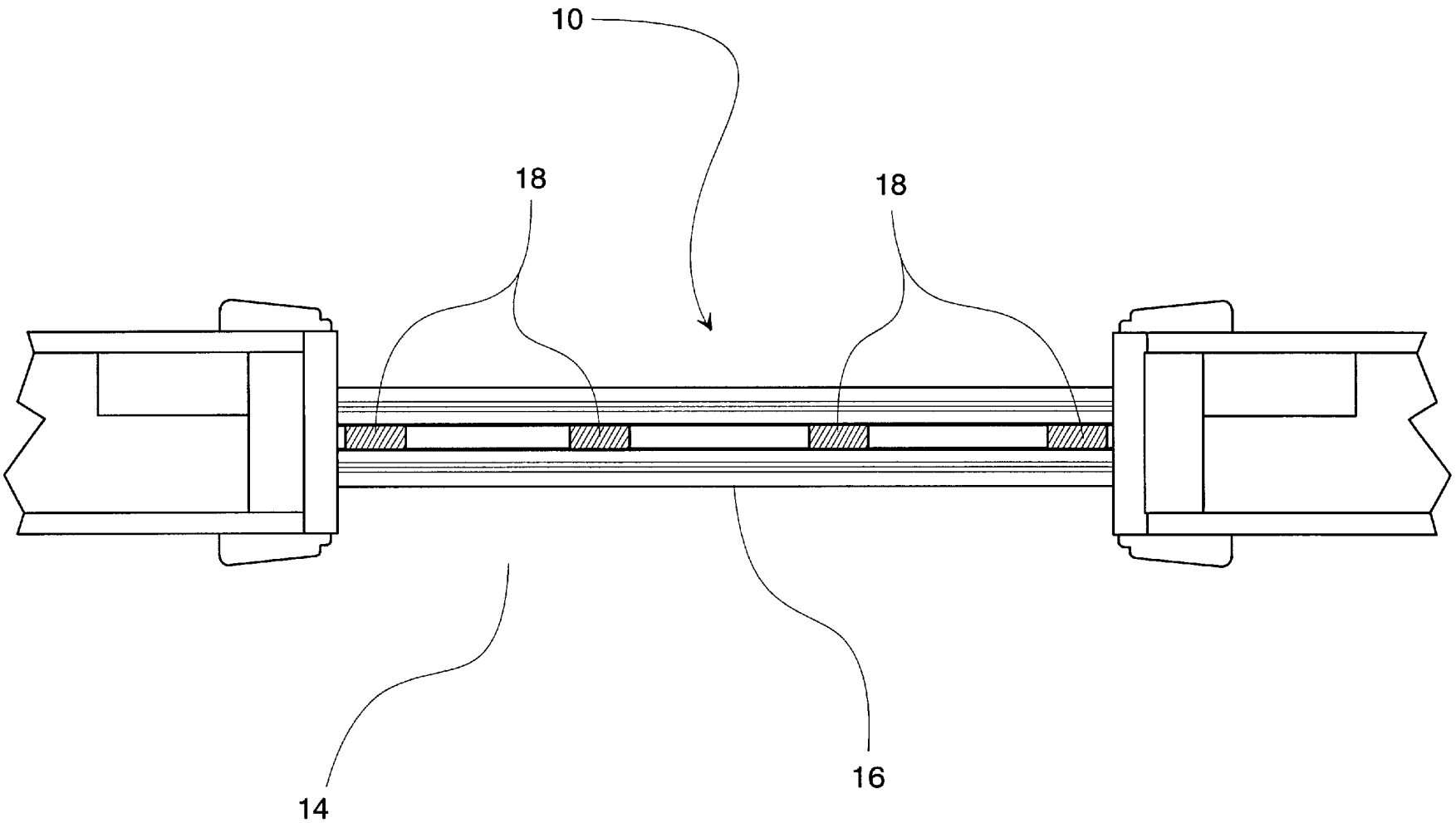
FIG. 2 is a top view of the track member and connecting members positioned within a doorway.
Figure 3:
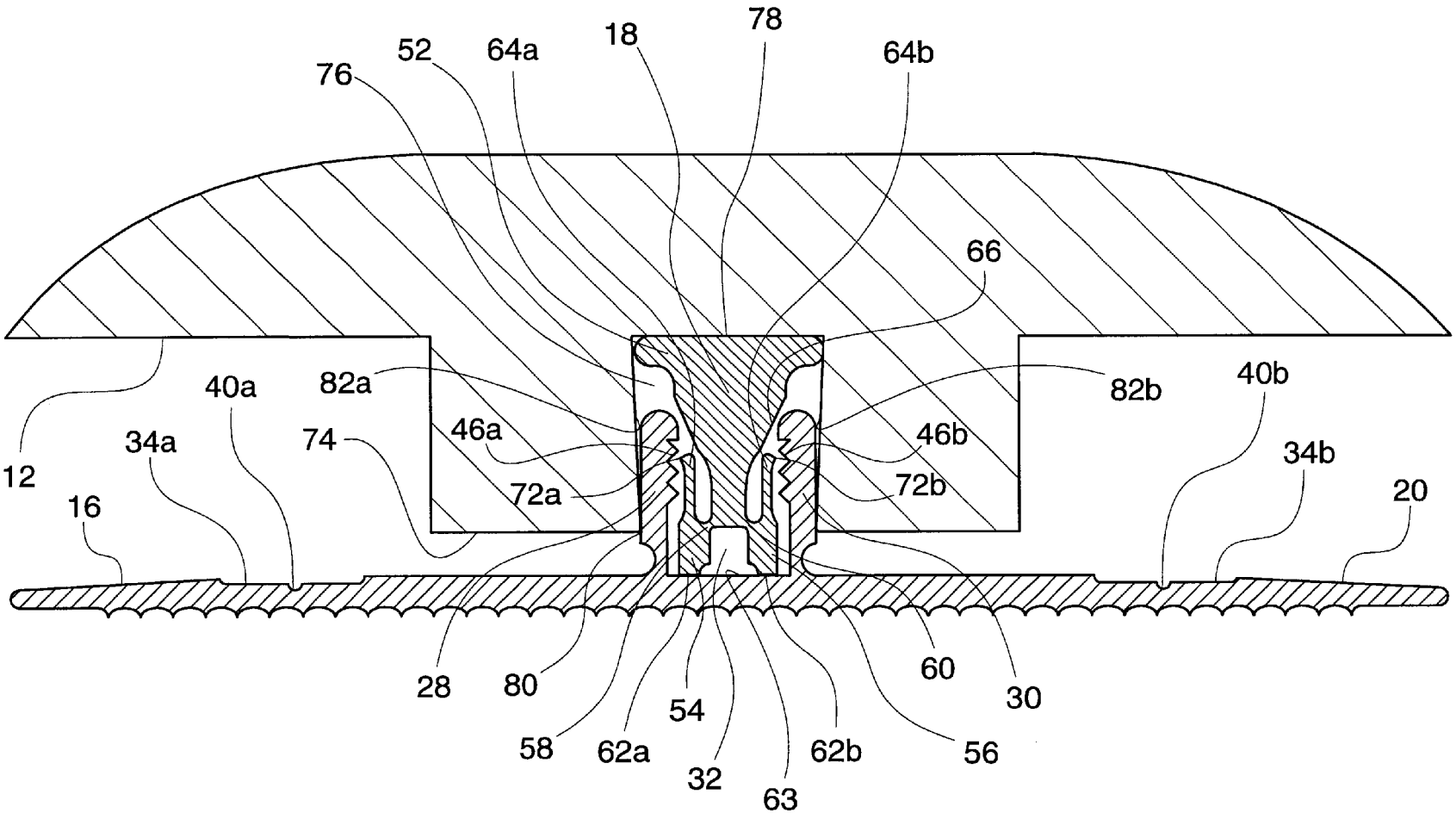
FIGS. 3, 4 and 5 are cross sectional views showing the steps associated with the installation of molding in accordance with the present invention.
Figure 4:
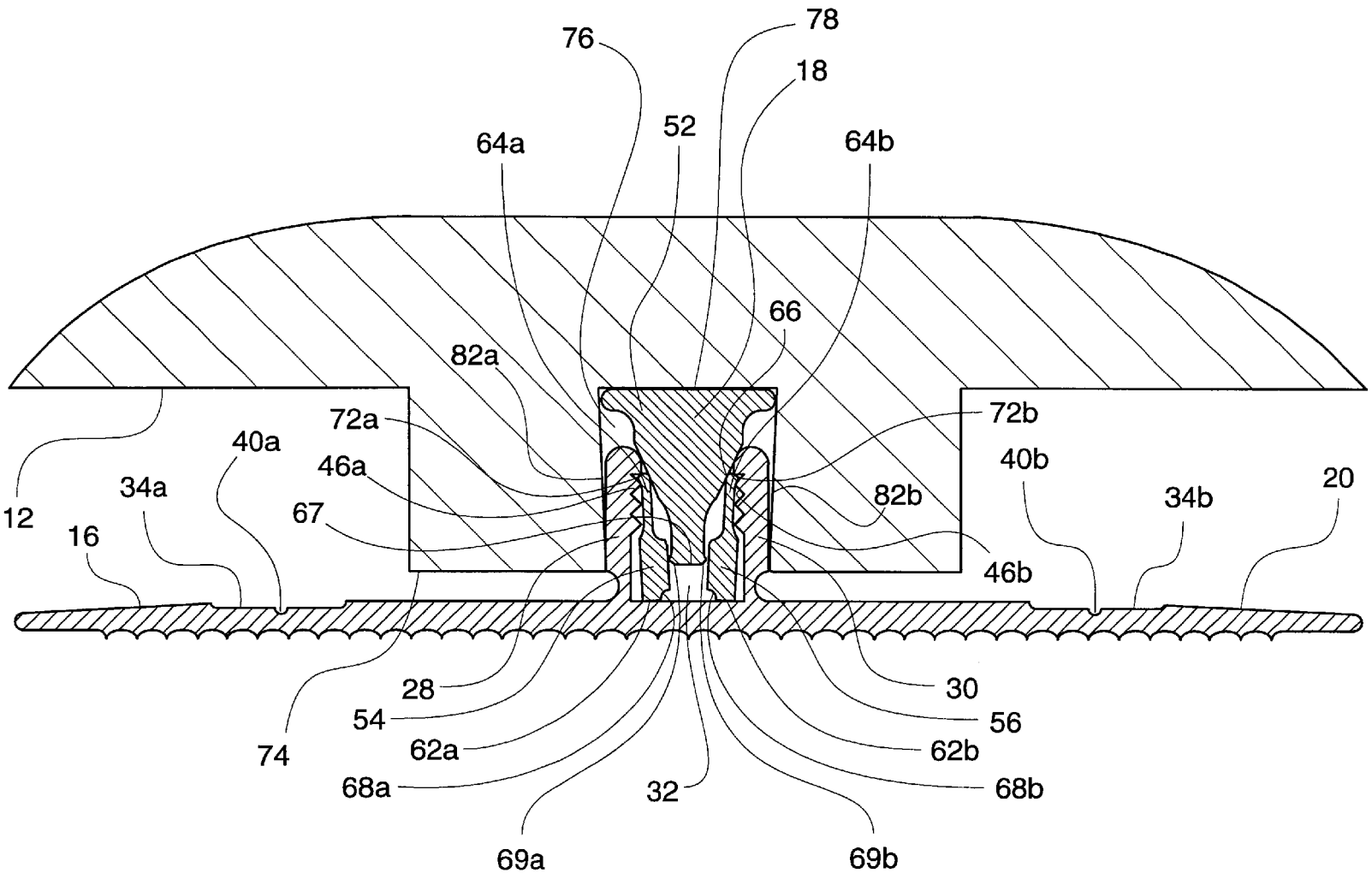
Figure 5:
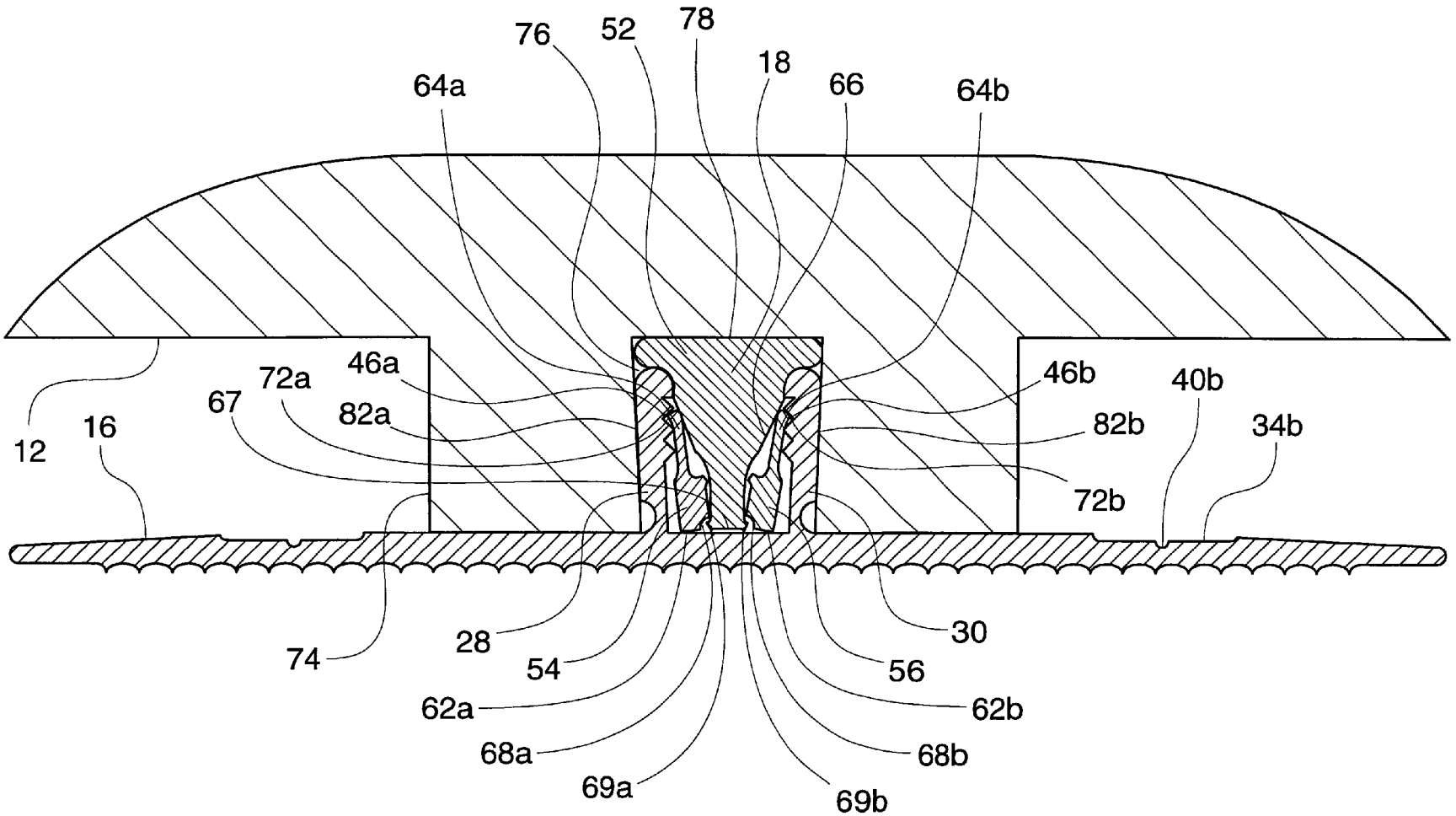
Figure 6:
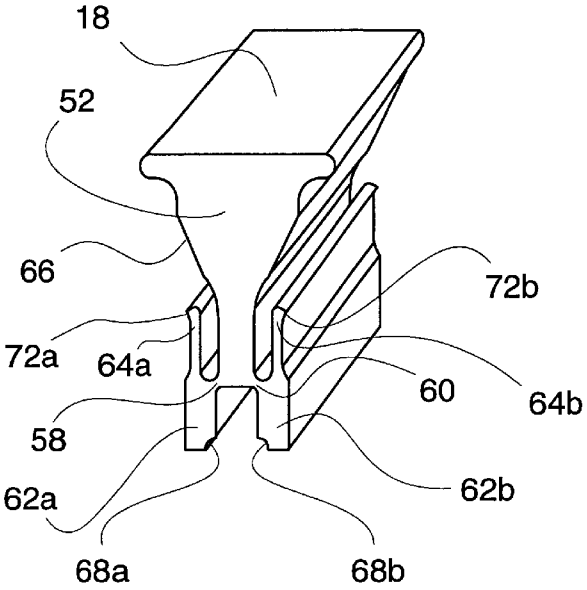
FIG. 6 is a perspective view of the connecting member.
Figure 7:
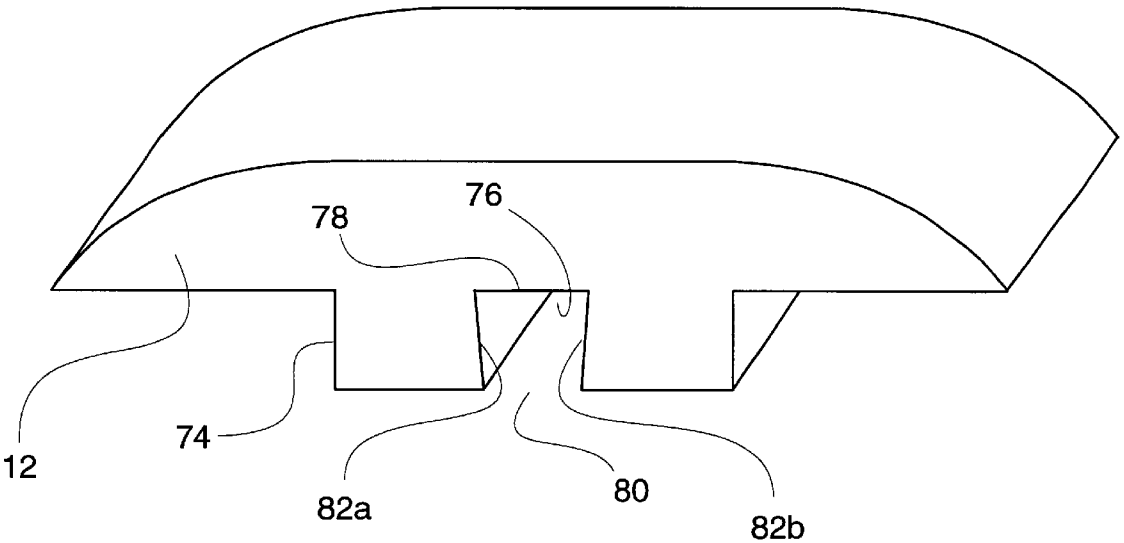
FIG. 7 is a perspective view of the molding.

With reference to FIG. 2, once the track member 16 is properly secured to the support surface 14, appropriate connecting members 18 are inserted, and spaced, within the channel 32 (for example, one connecting member every 12 inches). The molding 12 is then placed over the track member 16 and the connecting members 18.

In accordance with the preferred embodiment of the present invention, the molding 12 includes an underside 74 with a longitudinal recess 76 which is slightly larger than the exterior spacing between the upwardly extending flanges 28, 30 of the track member 16; that is, a female dovetail joint member. The recess is, however, formed such that the base 78 of the recess 76 is slightly wider than the open end 80 of the recess 76. That is, the walls 82*a*, 82*b* of the recess 76 taper in slightly, for example, by approximately 2½° each, as they extend from the base 78 of the recess 76 to the open end 80 of the recess 76.

As the molding 12 is pressed downwardly, pressure is applied to the central spike 52 breaking the first and second frangible joints 58, 60. That is, the first and second expansion members 54, 56 are broken from the central spike 52. The central spike 52 is then free to move downwardly within the channel 32, and between the first and second expansion members 54, 56.

As the central spike 52 moves downwardly between the first and second expansion members 54, 56, the outwardly tapering shaft 66 of the central spike 52 is brought into contact with the upper ends 64*a*, 64*b* of the first and second expansion members 54, 56, causing the first and second expansion member 54, 56 to expand outwardly and apply pressure to the upwardly extending flanges 28, 30. This pressure causes each flange 28, 30 to bow outwardly approximately 2½°.

It should be appreciated that the tapered shaft 66 should not begin forcing the upper ends 64*a*, 64*b* of the expansion members 54, 56 outwardly until the open end 80 of the molding 12 is at least approximately half way down the flanges 28, 30. In this way, outward bowing of the flanges 28, 30 does not impede the movement of the molding 12 over the track member 16. If the flanges 28, 30 were to begin bowing outwardly too early, the underside 74 of the molding 12 adjacent the recess 76 will contact the upper end of the flanges 28, 30 and damage the molding 12, the flanges 28, 30, or both.

The bowed flanges 28, 30 engage the walls 82*a*, 82*b* of the recess 76 formed in the underside 74 of the molding 12 to form a dovetail joint securely bind the molding 12 to the track member 16, and the support surface 14. That is, the combination of the outwardly bowed flanges 28, 30 and the tapered recess 76 form a dovetail joint which very securely binds the molding 12 to the track member 16.

The combination of the connecting members 18 bowing the flanges 28, 30 outwardly and the recess 76 (that is, female dovetail joint member) of the molding 12 forms a dovetail joint without the need for 90° insertion of adjacent members of a dovetail joint assembly. In this way, the present coupling assembly 10 provides a substantially permanent attachment mechanism for joining adjacent articles. In fact, once the molding 12 is properly secured to the track member 16, the molding 12 must be physically damaged to facilitate removal from the track member 16.

As discussed above, the unique shape of the connecting member 18 securely binds the connecting member 18 within the channel 32 as it applies pressure to the upwardly extending flanges 28, 30. In fact, the dogs 72*a*, 72*b* along the upper ends 64*a*, 64*b* of the first and second expansion members 54, 56 are designed to sequentially engage the ribs 46*a*, 46*b* formed along the interior surface 44*a*, 44*b* of the flanges 28, 30 as the molding 12 and connecting member 18 settle downwardly in relation to the track member 16. Specifically, as the connecting member 18, and the molding 12, move downwardly during settling, the dogs 72*a*, 72*b* move down and engage the next lower set of ribs to securely bind the connecting member 18 in position.

The prior discussion has primarily focused on the use of the present coupling assembly for securing transitional moldings to a floor surface. However, those skilled in the art will readily appreciate the wide range of uses for which the present invention may be employed. For example, the present coupling assembly could be used in the assembly of furniture or the construction of cabinets. In addition, the present coupling assembly may be used in the attachment of chair rails, crown molding, shoe molding and a variety of other moldings installed throughout a home or office.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A coupling assembly for securely coupling a first article to a second article, the coupling assembly comprising:

a connecting member selectively coupled to a track member;

the track member including first and second upwardly extending flanges defining a channel;

the connecting member shaped and dimensioned for secure attachment within the channel defined by the upwardly extending flanges; and wherein the connecting member includes first and second expansion members and a downwardly extending central spike positioned between the first and second expansion members, the first and second expansion members move outwardly as the connecting member is forced downwardly within the channel, and the central spike is moved downwardly between the first and second expansion members, to securely couple the connecting member within the track member and to force the first and second upwardly extending flanges outwardly into engagement with the first article such that the first article is securely coupled to the track member.

2. The coupling assembly according to claim 1, wherein the first expansion member and the second expansion member move outwardly as the central spike is forced downwardly within the channel to securely couple the connecting member within the track member and to force the first and second upwardly extending flanges outwardly into engagement with the first article such that the first article is securely coupled to the track member.

3. The coupling assembly according to claim 2, wherein the first expansion member is frangibly connected to the central spike such that the first expansion member breaks from the central spike as the central spike is forced downwardly within the channel.

4. The coupling assembly according to claim 1, wherein the first expansion member is frangibly connected to the central spike such that the first expansion member breaks from the central spike as the central spike is forced downwardly within the channel.

5. The coupling assembly according to claim 1, wherein the spike member includes a lower end and an upper end, and the lower end includes first and second recesses shaped and dimensioned for respectively receiving a lower end of the first expansion member and a lower end of the second expansion member to securely bind the connecting member in position within the channel.

6. The coupling assembly according to claim 1, wherein the first upwardly extending flange includes an interior surface and an exterior surface, and ribs are formed along the interior surface of the first upwardly extending flange; and the second upwardly extending flange includes an interior surface and an exterior surface, and ribs are formed along the interior surface of the second upwardly extending flange.

7. The coupling assembly according to claim 6, wherein the connecting member includes engaging members which engage the ribs of the first and second upwardly extending flanges to securely bind the connecting member in position within the channel.

8. The coupling assembly according to claim 1, wherein the first upwardly extending flange includes an interior surface and an exterior surface, and ribs are formed along the interior surface of the first upwardly extending flange; and the second upwardly extending flange includes an interior surface and an exterior surface, and ribs are formed along the interior surface of the second upwardly extending flange.

9. The coupling assembly according to claim 8, wherein the connecting member includes engaging members which engage the ribs of the first and second upwardly extending flanges to securely bind the connecting member in position within the channel.

10. A connecting member adapted for coupling a first article to a track member secured to a support surface, wherein the track member includes first and second upwardly extending flanges defining a channel and the connecting member is substantially positioned between the first article and track member to effectively couple the first article to the support surface, the connecting member comprising:

a downwardly extending central spike;

a first expansion member extending from one side of the central spike and a second expansion member extending from an opposite side of the central spike, the downwardly extending central spike being positioned substantially between the first expansion member and the second expansion member; and wherein the first expansion member and the second expansion member move outwardly as the central spike is forced downwardly between the first and second expansion members and within the channel to securely couple the connecting member within the track member and to force the first and second upwardly extending flanges outwardly into engagement with the first article such that the first article is securely coupled to the track member.

11. The connecting member according to claim 10, wherein the first expansion member is frangibly connected to the central spike such that the first expansion member breaks from the central spike as the central spike is forced downwardly within the channel.

12. The connecting member according to claim 10, wherein the first expansion member and the second expansion member move outwardly as the central spike is forced downwardly within the channel to securely couple the connecting member within the track member and to force the first and second upwardly extending flanges outwardly into engagement with the first article such that the first article is securely coupled to the track member.

13. The connecting member according to claim 12, wherein the first expansion member is frangibly connected to the central spike such that the first expansion member breaks from the central spike as the central spike is forced downwardly within the channel.

14. The connecting member according to claim 10, wherein the spike member includes a lower end and an upper end, and the lower end includes first and second recesses shaped and dimensioned for respectively receiving a lower end of the first expansion member and a lower end of the second expansion member to securely bind the connecting member in position within the channel.

15. The connecting member according to claim 10, wherein the first upwardly extending flange includes an interior surface and an exterior surface, and ribs are formed along the interior surface of the first upwardly extending flange; and the second upwardly extending flange includes an interior surface and an exterior surface, and ribs are formed along the interior surface of the second upwardly extending flange.

16. The connecting member according to claim 15, wherein the connecting member includes engaging member s which engage the ribs of the first and second upwardly extending flanges to securely bind the connecting member in position within the channel.

17. The connecting member according to claim 10, wherein the first upwardly extending flange includes an interior surface and an exterior surface, and ribs are formed along the interior surface of the first upwardly extending flange; and the second upwardly extending flange includes an interior surface and an exterior surface, and ribs are formed along the interior surface of the second upwardly extending flange.

18. The connecting member according to claim 17, wherein the connecting member includes engaging member s which engage the ribs of the first and second upwardly extending flanges to securely bind the connecting member in position within the channel.

19. A multi-component article, comprising:

a coupling assembly connecting a first member to a second member;

the coupling assembly including a track member secured to the second member, the track member includes first and second upwardly extending flanges defining a channel;

the coupling assembly further including a connecting member shaped and dimensioned for secure attachment within the channel defined by the upwardly extending flanges, the connecting member including first and second expansion members and a downwardly extending central spike positioned between the first and second expansion members, the first and second expansion members move outwardly as the connecting member is forced downwardly within the channel, and the central spike is moved downwardly between the first and second expansion members, to securely couple the connecting member within the track member and to force the first and second upwardly extending flanges outwardly into engagement with the first member such that the first member is securely coupled to the second member.

20. The multi-component article according to claim 19, wherein the first expansion member is frangibly connected to the central spike such that the first expansion member breaks from the central spike as the central spike is forced downwardly within the channel.

21. The multi-component article according to claim 19, wherein the first expansion member and the second expansion member move outwardly as the central spike is forced downwardly within the channel to securely couple the connecting member within the track member and to force the first and second upwardly extending flanges outwardly into engagement with the first article such that the first article is securely coupled to the track member.

22. The multi-component article according to claim 19, wherein the spike member includes a lower end and an upper end, and the lower end includes first and second recesses shaped and dimensioned for respectively receiving a lower end of the first expansion member and a lower end of the second expansion member to securely bind the connecting member in position within the channel.

23. The multi-component article according to claim 19, wherein the first upwardly extending flange includes an interior surface and an exterior surface, and ribs are formed along the interior surface of the first upwardly extending flange; and the second upwardly extending flange includes an interior surface and an exterior surface, and ribs are formed along the interior surface of the second upwardly extending flange.

24. The multi-component article according to claim 23, wherein the connecting member includes engaging member s which engage the ribs of the first and second upwardly extending flanges to securely bind the connecting member in position within the channel.

25. The multi-component article according to claim 19, wherein the first upwardly extending flange includes an interior surface and an exterior surface, and ribs are formed along the interior surface of the first upwardly extending flange; and the second upwardly extending flange includes an interior surface and an exterior surface, and ribs are formed along the interior surface of the second upwardly extending flange.

26. The multi-component article according to claim 25, wherein the connecting member includes engaging member s which engage the ribs of the first and second upwardly extending flanges to securely bind the connecting member in position within the channel.

27. A coupling assembly for securely coupling a first article to a second article, the coupling assembly comprising:

a connecting member selectively coupled to a track member;

the track member including first and second upwardly extending flanges defining a channel;

the connecting member shaped and dimensioned for secure attachment within the channel defined by the upwardly extending flanges, the connecting member includes first and second expansion members and a central spike, the first expansion member extending from one side of the central spike and the second expansion member extending from an opposite side of the central spike; and wherein the first and second expansion members move outwardly as the connecting member and central spike are forced downwardly within the channel, the first expansion member being frangibly connected to the central spike such that the first expansion member breaks from the central spike as the central spike is forced downwardly within the channel, to securely couple the connecting member within the track member and to force the first and second upwardly extending flanges outwardly into engagement with the first article such that the first article is securely coupled to the track member.

28. A connecting member adapted for coupling a first article to a track member secured to a support surface, wherein the track member includes first and second upwardly extending flanges defining a channel and the connecting member is substantially positioned between the first article and track member to effectively couple the first article to the support surface, the connecting member comprising:

a central spike;

a first expansion member extending from one side of the central spike and a second expansion member extending from an opposite side of the central spike; and wherein the first expansion member and the second expansion member move outwardly as the central spike is forced downwardly within the channel, the first expansion member being frangibly connected to the central spike such that the first expansion member breaks from the central spike as the central spike is forced downwardly within the channel, to securely couple the connecting member within the track member and to force the first and second upwardly extending flanges outwardly into engagement with the first article such that the first article is securely coupled to the track member.

29. A multi-component article, comprising:

a coupling assembly connecting a first member to a second member;

the coupling assembly including a track member secured to the second member, the track member includes first and second upwardly extending flanges defining a channel;

the first upwardly extending flange includes an interior surface and an exterior surface, and ribs are formed along the interior surface of the first upwardly extending flange; and the second upwardly extending flange includes an interior surface and an exterior surface, and ribs are formed along the interior surface of the second upwardly extending flange;

the coupling assembly further including a connecting member shaped and dimensioned for secure attachment within the channel defined by the upwardly extending flanges, the connecting member including first and second expansion members and a central spike, the first expansion member extending from one side of the central spike and the second expansion member extending from an opposite side of the central spike, the first and second expansion members move outwardly as the connecting member is forced downwardly within the channel to securely couple the connecting member within the track member and to force the first and second upwardly extending flanges outwardly into engagement with the first member such that the first member is securely coupled to the second member.

* * * * *